US008217246B2

(12) United States Patent
Sangster

(10) Patent No.: US 8,217,246 B2
(45) Date of Patent: Jul. 10, 2012

(54) SLIDING CHORD PRODUCING DEVICE FOR A GUITAR AND METHOD OF USE

(76) Inventor: David Sangster, Bagminette, AL (US)

( * ) Notice: Subject to any disclaimer, the term of this patent is extended or adjusted under 35 U.S.C. 154(b) by 35 days.

(21) Appl. No.: 12/832,309

(22) Filed: Jul. 8, 2010

(65) Prior Publication Data

US 2011/0005368 A1 Jan. 13, 2011

Related U.S. Application Data

(60) Provisional application No. 61/224,221, filed on Jul. 9, 2009.

(51) Int. Cl.
*G10D 3/00* (2006.01)

(52) U.S. Cl. ..... 84/315

(58) Field of Classification Search ..... 84/315–319
See application file for complete search history.

(56) References Cited

U.S. PATENT DOCUMENTS 3,822,629 A * 7/1974 Smith ..... 84/319

* cited by examiner

*Primary Examiner* — Kimberly Lockett
(74) *Attorney, Agent, or Firm* — Michael Ries

(57) ABSTRACT

The present invention is a sliding chord producing device and method of use for a user playing a guitar with a neck, a plurality of strings and a plurality of frets. The device has a generally tubular metal handle with two metal support rods that can be grasped by the user that are perpendicularly attached to the handle. There is also a vertical generally tubular metal slide and a diagonal generally tubular metal slide that are in movable contact with the neck, the strings and the frets that are perpendicularly attached to the handle by the support rods at a fixed angle forming the device. The device can also be made of glass.

18 Claims, 5 Drawing Sheets

SLIDING CHORD PRODUCING DEVICE FOR A GUITAR AND METHOD OF USE

This application claims priority to U.S. Provisional Application 61/224,221 filed on Jul. 9, 2009, the entire disclosure of which is incorporated by reference.

TECHNICAL FIELD & BACKGROUND

The present invention generally relates to a sliding chord producing device for a guitar and method of use. More specifically, the invention is a sliding chord producing device and method of use for a guitar that utilizes a vertical bar and a diagonal bar.

It is an object of the invention to provide a sliding chord producing device and method of use for a guitar that allows a user a wide range of musical movements on the guitar.

It is an object of the invention to provide a sliding chord producing device and method of use for a guitar that can play more chords and more than one fret at a time, giving a wider range of pitches and more chord voicings.

It is an object of the invention to provide a sliding chord producing device and method of use for a guitar that allows a user to achieve an accurate and higher melody range.

It is an object of the invention to provide a sliding chord producing device and method of use for a guitar that can simultaneously play a wider range of pitches than attainable through a traditional guitar slide.

What is really needed is a sliding chord producing device and method of use for a guitar that allows a user a wide range of musical movements on a guitar, that can play more chords and more than one fret at a time, giving a wider range of pitches and more chord voicings, that allows a user to achieve an accurate and higher melody range and that can simultaneously play a wider range of pitches than attainable through a traditional regular guitar slide.

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments.

Various operations will be described as multiple discrete operations, in turn, in a manner that is most helpful in understanding the present invention. However, the order of description should not be construed as to imply that these operations are necessarily order dependent. In particular, these operations need not be performed in the order of presentation.

The phrase "in one embodiment" is used repeatedly. The phrase generally does not refer to the same embodiment, however, it may. The terms "comprising", "having" and "including" are synonymous, unless the context dictates otherwise.

Figure 1A:
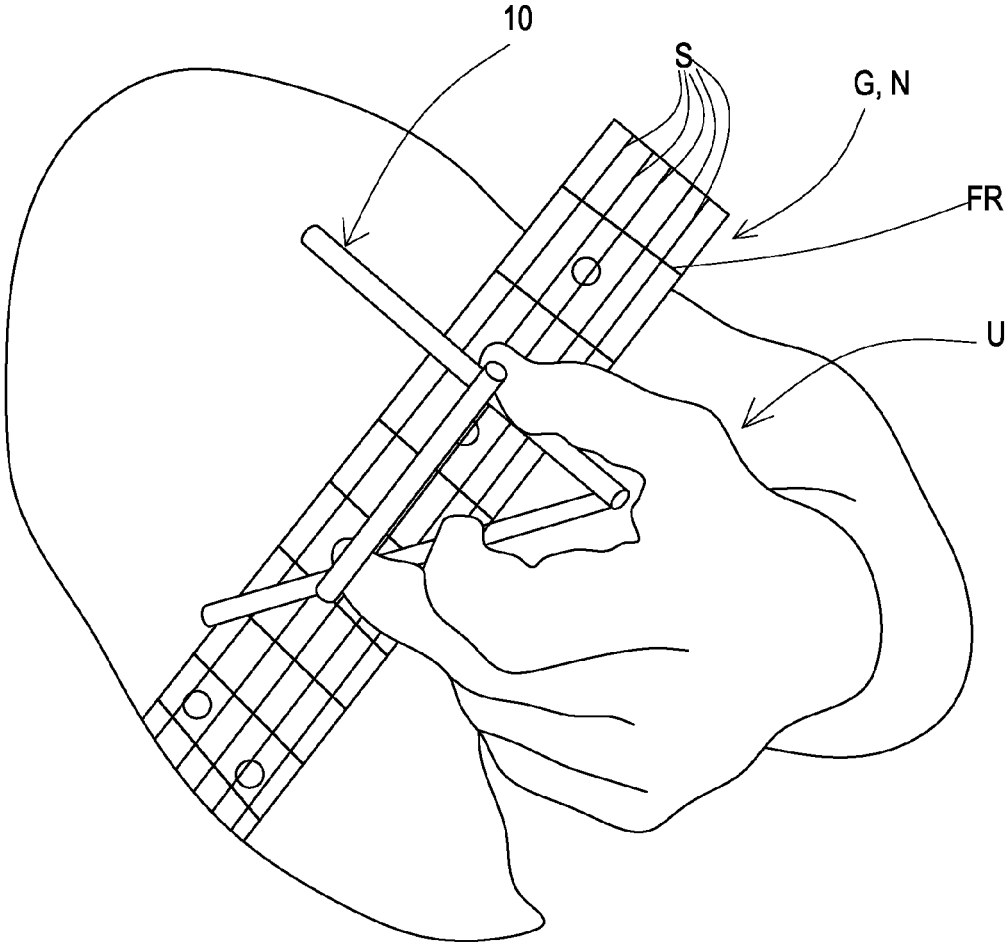
FIG. 1A illustrates a top environmental perspective view of a sliding chord producing device for a guitar, by a right-handed guitar player, in accordance with one embodiment of the present invention.
Figure 1B:
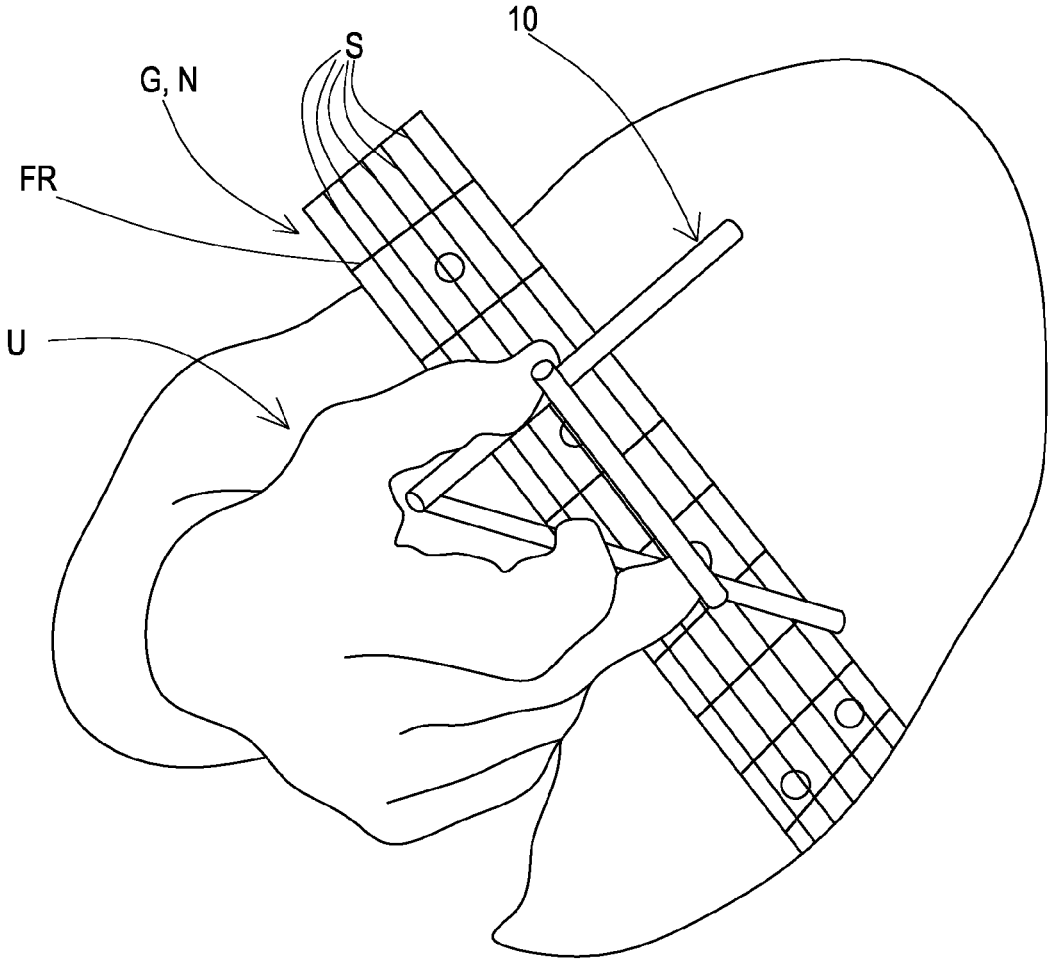
FIG. 1B illustrates a top environmental perspective view of a sliding chord producing device for a guitar by a left-handed guitar player, in accordance with one embodiment of the present invention.

FIGS. 1A and 1B illustrate a top environmental perspective view of a sliding chord producing device for a guitar 10, in accordance with one embodiment of the present invention. The sliding chord producing device 10 is designed for a user U playing a guitar G with a neck N, a plurality of strings S and a plurality of frets FR. FIGS. 1A and 1B illustrate the device 10 being used for a left-handed and right-handed guitar player.

Figure 2:
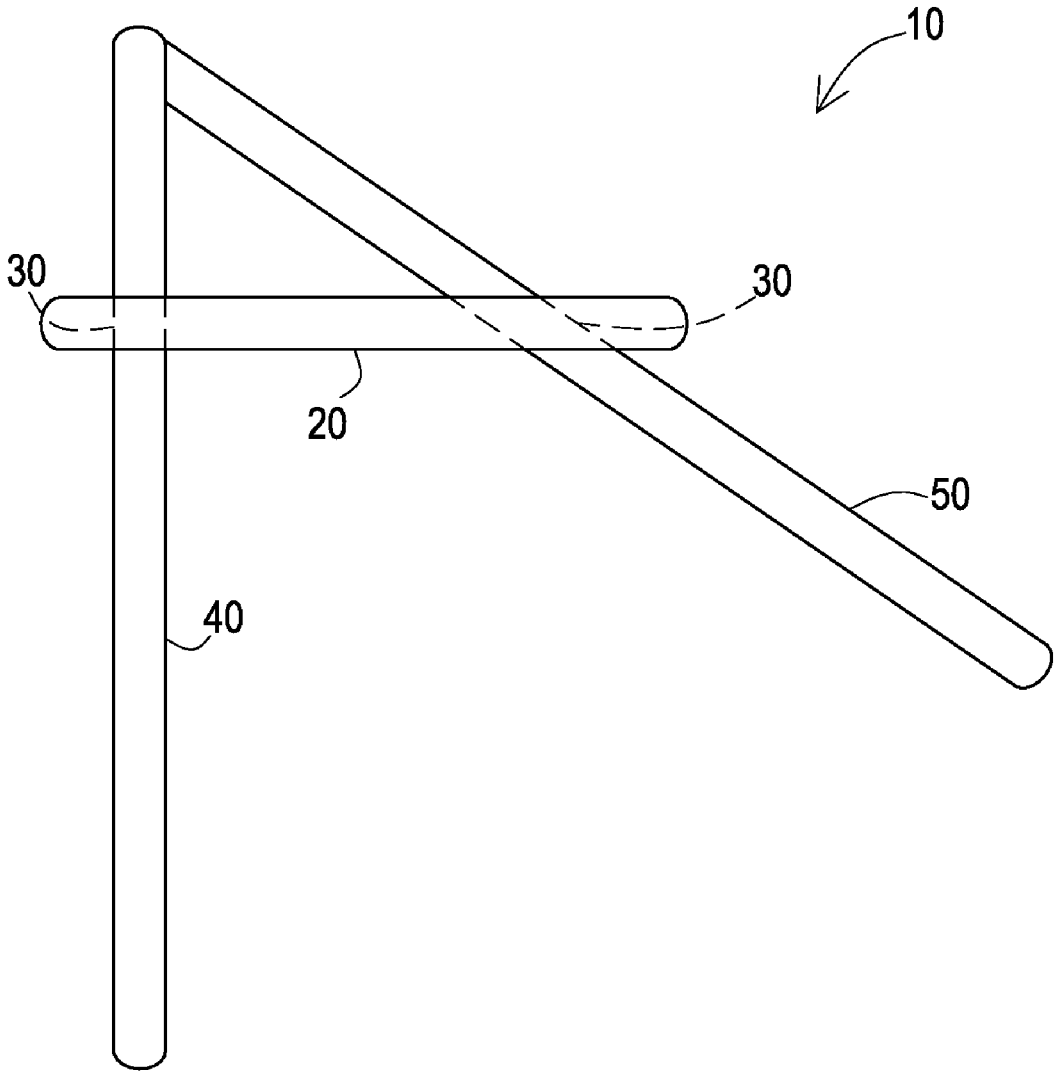
FIG. 2 illustrates a top perspective view of a sliding chord producing device for a guitar, in accordance with one embodiment of the present invention.
Figure 3:
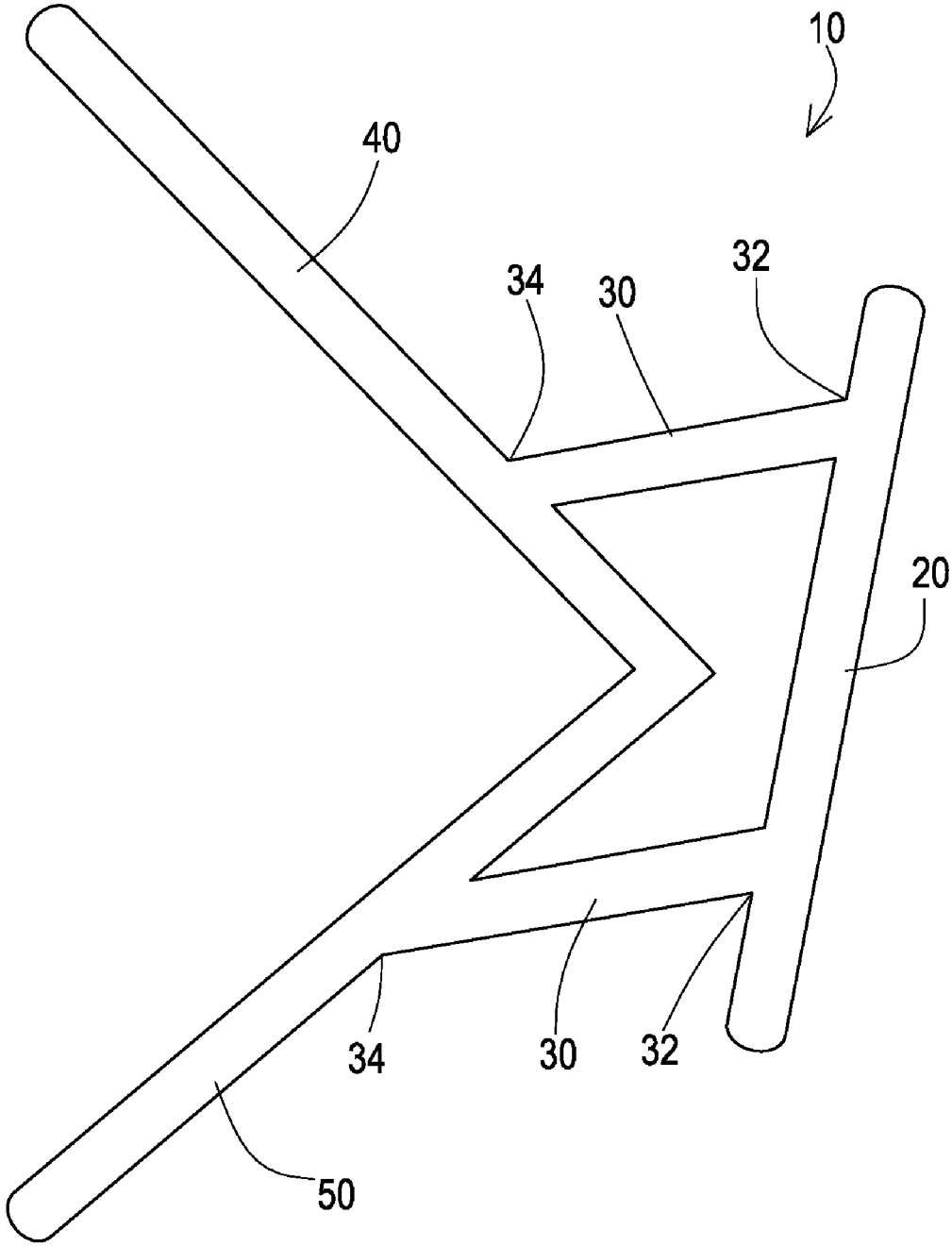
FIG. 3 illustrates a diagonal side perspective view of a sliding chord producing device for a guitar, in accordance with one embodiment of the present invention.

FIG. 2 illustrates a top perspective view of a sliding chord producing device for a guitar 10, in accordance with one embodiment of the present invention. FIG. 3 illustrates a diagonal side perspective view of a sliding chord producing device for a guitar 10, in accordance with one embodiment of the present invention. The sliding chord device 10 has a generally tubular metal handle 20 with two metal support rods 30 that can be grasped by the user U, the rods 30 each having a proximal end 32 and a distal end 34 that are perpendicularly attached to the handle 20. There is also a vertical generally tubular metal slide 40 and a diagonal generally tubular metal slide 50 that are in movable contact with the neck N, the strings S and the frets FR that are perpendicularly attached to the handle 20 by the support rods 30 at a fixed angle forming the sliding chord device 10. The proximal end of each rod 32 is weldedly attached to the handle 20 by a weld that can be any type of weld that is well known to those in the art. Similarly, the distal end of each rod 34 is weldedly attached to the vertical slide 40 and the diagonal slide 50 by a weld that can be any type of weld that is well known to those in the art. The fixed angle formed by the vertical metal slide 40 and the diagonal metal slide 50 is approximately 56 degrees, which is the best mode angle for the device 10.

The user U moves the sliding chord device 10 as desired along the neck N, strings S and frets FR to produce desired guitar music. The sliding chord device 10 allows the user U a wider range of musical movements on the guitar G. The user U can play more chords and more than one fret at a time, giving a wider range of pitches and more chord voicings than if the user U used an ordinary slide. The user U can emulate steel, blues and rock guitar on a standard guitar using the sliding chord device 10. The device 10 also allows the user U to play standard or open tuning music effortlessly without having to retune the guitar G. The design of the sliding chord device 10 gives the user U a built-in guide, via the unique design, to achieve an accurate, higher melody range than attainable without the device 10. The user U holds the device 10 on top of the strings S and frets FR of the guitar G to obtain the musical sounds desired. The sliding chord device 10 is used to create a wider range of pitches and chords on a guitar G. Through being a combination of a vertical bar 40 and a diagonal bar 50, held at a fixed angle in alignment with the strings S and frets FR, the user U can simultaneously play a wider range of pitches than previously obtainable through a traditional guitar slide.

Use of the sliding chord producing device for a guitar 10 is straightforward. The device 10 plays two types of chord shapes, one being at a vertical angle, like a regular slide device would play, and the other being at a diagonal angle. The device 10 can morph the first type of chord shape into the second type of chord shape while keeping a fulltime sustain of the chords. The device 10 does two kinds of tuning, standard and open tuning. Since the device 10 is a combination slide, the user U can move the device 10 in any angular direction, as opposed to only a horizontal direction with a regular guitar slide. A guitar player can perform hammer-ons, trills, sliding hammer-ons and trills and simultaneously lengthen and shorten the interval between two or more notes being played. A user U can emulate a dobro on a regular acoustic guitar, emulate a steel guitar as well as emulate blues and rock style guitars. Either the vertical slide 40 or the diagonal slide 50 can be interchangeably used while the user U is playing with the device 10. The user U can play higher in pitch and position on the guitar strings and maintain pitch and tuning more effectively than a regular slide. The device 10 can play chord forms such as a major chord, a minor chord, a major seventh chord and other chords that are well known in the art, in new positions that would be very difficult to play with a regular slide.

A preferred embodiment of the device 10 includes its unique design. If bar 40 is held over the 12th fret along with support rod 30 held vertically over the 2nd string, then bar 50 lines up perfectly with the next chord formation. This is the only place on the neck where both chords can line up perfectly at once, at the very center and logical point of the neck.

One embodiment of the device 10 includes the device 10 being made of glass instead of metal. The tubular handle 20, support rods 30, vertical tubular slide 40 and diagonal tubular slide 50 would also be made of glass, but would be slightly thicker. The device 10 made of glass would have all of the other features of the device 10 made of metal including the approximate 56 degree angle formed by the vertical metal slide 40 and the diagonal metal slide 50, except that the welds between the tubular metal handle 20, the support rods 30, the vertical tubular slide 40 and the diagonal tubular slide 50 would be glass welds. The tubular handle 20 made of glass could also be slightly different than the tubular handle 20 made of metal.

Figure 4:
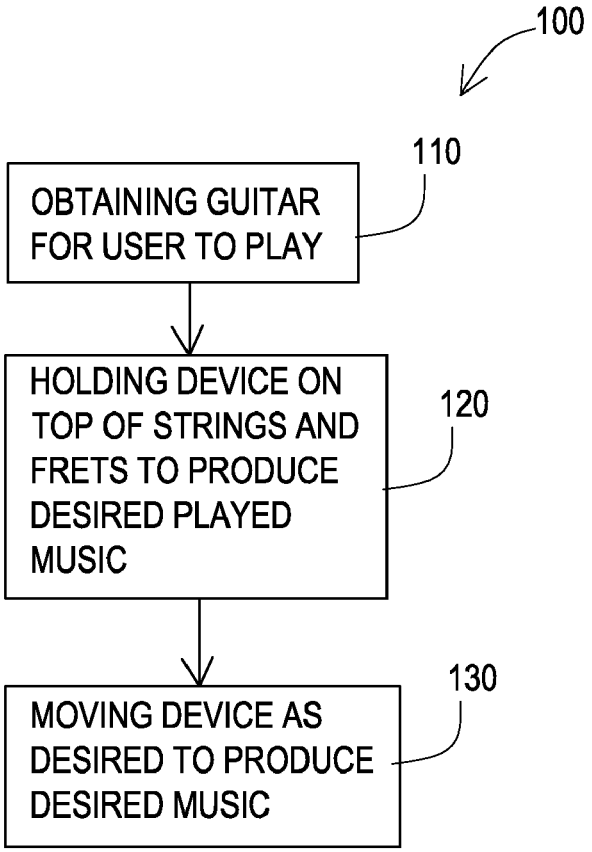
FIG. 4 illustrates a flow diagram of a method of using a sliding chord producing device for a guitar, in accordance with one embodiment of the present invention.

FIG. 4 illustrates a flow diagram of a method of using a sliding chord producing device for a guitar 100, in accordance with one embodiment of the present invention. The steps of the method of using a sliding chord producing device for a guitar 100 include obtaining the guitar for the user to play 110, holding the device on top of the strings and frets of the guitar to begin producing desired guitar music 120 and moving the device as desired along the neck the strings and frets to produce the desired guitar music 130.

The user can moves the device as desired to emulate a steel guitar and a blues and rock guitar on a standard guitar and using the vertical slide and the diagonal slide interchangeably while the user is using the device. Moving the device includes playing two types of chord shapes, one being at a vertical angle and one being at a diagonal angle and performing hammer-ons, trills, sliding hammer-ons and trills and simultaneously lengthen and shorten an interval between two or more notes being played. Moving the device includes morphing the vertical angle chord shape into the diagonal chord shape while keeping a fulltime sustain of chords being played. Moving the device includes playing more chords and more than one fret at a time with the device and playing a major chord, a minor chord, a major seventh chord and other chord forms. Moving the device includes allowing the user to play standard and open tuning music without having to retune the guitar and moving the device in any angular direction.

While the present invention has been related in terms of the foregoing embodiments, those skilled in the art will recognize that the invention is not limited to the embodiments described. The present invention can be practiced with modification and alteration within the spirit and scope of the appended claims. Thus, the description is to be regarded as illustrative instead of restrictive on the present invention.

What is claimed is:

1. A sliding chord producing device for a user playing a guitar with a neck, a plurality of strings and a plurality of frets, comprising:

a generally tubular metal handle with two metal support rods that can be grasped by said user, said rods each with a proximal end and a distal end that are perpendicularly attached to said handle; and a vertical generally tubular metal slide and a diagonal generally tubular metal slide that are in movable contact with said neck, said strings and said frets that are perpendicularly attached to said handle by said support rods at a fixed angle forming said device.

2. The device according to claim 1, wherein said proximal ends of rods are weldedly attached to said handle.

3. The device according to claim 1, wherein said distal ends of rods are weldedly attached to said vertical slide and said diagonal slide.

4. The device according to claim 1, wherein said fixed angle is approximately 56 degrees.

5. The device according to claim 1, wherein said device allows said user to play standard and open tuning music without having to retune said guitar.

6. The device according to claim 1, wherein said device serves said user as a built-in guide to achieve a more accurate and higher melody range than without said device.

7. the device according to claim 1, wherein said device can play a vertical angle chord shape and a diagonal angle chord shape.

8. The device according to claim 7, wherein said device can morph said vertical angle chord shape into said diagonal chord shape while keeping a fulltime sustain of chords being played.

9. The device according to claim 1, wherein said device does standard tuning and open tuning.

10. The device according to claim 1, wherein said user can move said device in any angular direction.

11. The device according to claim 1, wherein said user can perform hammer-ons, trills, sliding hammer-ons and trills, simultaneously lengthen and shorten an interval between two or more notes being played and play a major chord, a minor chord, a major seventh chord and other chord forms.

12. The device according to claim 1, wherein said vertical slide and said diagonal slide can be interchangeably used while said user is using said device.

13. The device according to claim 1, wherein said device allows said user to play higher in pitch and position on said strings and maintain pitch and tuning better than a regular slide.

14. The device according to claim 1, wherein said device, said tubular handle, said support rods, said vertical tubular slide and said diagonal tubular slide are made of glass.

15. A method of using a sliding chord producing device for a user playing a guitar with a neck, a plurality of strings and a plurality of frets with a vertical slide and a diagonal slide bar, comprising the steps of:

moving said device that includes playing two types of chord shapes, one said shape being at a vertical angle and one said shape being at a diagonal angle and performing hammer-ons, trills, sliding hammer-ons and trills and simultaneously lengthen and shorten an interval between two or more notes being played.

16. The method according to claim 15, wherein said moving said device includes morphing said vertical angle chord shape into said diagonal chord shape while keeping a fulltime sustain of chords being played.

17. The method according to claim 15, wherein said moving said device includes playing more chords and more than one said fret at a time with said device and playing a major chord, a minor chord, a major seventh chord and other chord forms.

18. The method according to claim 15, wherein said moving said device includes allowing said user to play standard and open tuning music without having to retune said guitar and moving said device in any angular direction.

* * * * *